US010416605B2

(12) United States Patent
Iwakawa

(10) Patent No.: US 10,416,605 B2
(45) Date of Patent: Sep. 17, 2019

(54) CLEANING DEVICE AND IMAGE FORMING APPARATUS INCLUDING THE SAME

(71) Applicant: CANON KABUSHIKI KAISHA, Tokyo (JP)

(72) Inventor: Tadashi Iwakawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/645,890

(22) Filed: Jul. 10, 2017

(65) Prior Publication Data

US 2018/0017931 A1 Jan. 18, 2018

(30) Foreign Application Priority Data

Jul. 13, 2016 (JP) ..... 2016-138755

(51) Int. Cl.
*G03G 21/00* (2006.01)
*G03G 15/16* (2006.01)

(52) U.S. Cl.
CPC ..... *G03G 21/0035* (2013.01); *G03G 15/161* (2013.01)

(58) Field of Classification Search
CPC ..... G03G 21/0035
See application file for complete search history.

(56) References Cited

U.S. PATENT DOCUMENTS 3,590,412 A * 7/1971 Gerbasi ..... G03C 8/06 118/16
3,942,889 A * 3/1976 Kurita ..... G03G 21/0035 15/1.51
5,019,870 A * 5/1991 Bares ..... G03G 15/0889 399/256
5,625,443 A * 4/1997 Ohta ..... G03G 21/0035 399/353
5,797,078 A * 8/1998 Sass ..... G03G 21/0035 399/353
6,961,534 B2 * 11/2005 Fiore ..... G03G 21/0035 399/353

FOREIGN PATENT DOCUMENTS

JP 63-137286 A 6/1988
JP 2003-263085 A 9/2003
JP 2014-228849 A 12/2014

* cited by examiner

*Primary Examiner* — G.M. A Hyder
(74) *Attorney, Agent, or Firm* — Canon U.S.A., Inc. IP Division

(57) ABSTRACT

There is provided a cleaning device in which both sidewalls of a scraper holding unit are formed so that a center line between both the sidewalls of the scraper holding unit is directed substantially toward the center of a fur brush.

15 Claims, 8 Drawing Sheets

CLEANING DEVICE AND IMAGE FORMING APPARATUS INCLUDING THE SAME

BACKGROUND

Field of the Disclosure

The present disclosure relates to a cleaning device and an image forming apparatus using an electrophotographic method including the same.

Description of the Related Art

As is well known, in an image forming apparatus using an electrophotographic method, there are provided image bearing members (photosensitive members) the number of which is the same as the number of colors required for image formation. A charging unit, an image exposure unit, a development unit, and a cleaning unit are provided around the photosensitive member, and a toner image in a single color formed on each of the image bearing members is superimposed on and transferred (primarily transferred) onto an intermediate transfer member serving as a belt member. A visible image borne on an intermediate transfer belt is transferred (secondarily transferred) onto transfer paper such as plain paper, to obtain a recorded image. The transfer paper onto which the visible image has been transferred from the intermediate transfer belt is conveyed to a fixing device, and is discharged after the visible image has been fixed thereto.

Residual transfer toner remaining on the photosensitive member and the intermediate transfer belt after the transfer is scraped by a cleaning unit, and the scraped toner is conveyed outward from a cleaning container by a conveyance screw serving as a toner conveyance unit. As the cleaning unit, a cleaning brush and a cleaning blade are respectively arranged upstream and downstream thereof, for example. In this case, a part of the residual transfer toner enters the cleaning brush. If the toner has entered the cleaning brush, the cleaning brush does not show a desired cleaning performance. Thus, at least the toner, which has entered a leading end portion of the cleaning brush contacting the photosensitive member and the intermediate transfer belt, needs to be removed.

A technique for removing toner, which has entered the cleaning brush, includes a technique for electrically removing toner by causing a charged recovery roller to abut on a cleaning brush and a technique for physically flicking toner by causing a thin plate-shaped scraper to thrust into the cleaning brush.

Japanese Patent Application Laid-Open No. 2014-228849 also discusses a technique for physically flicking toner by causing a round bar-shaped scraper to thrust into a cleaning brush.

The round bar-shaped scraper is a cost cutting measure compared with the charged recovery roller, and is more advantageous for cutting bristles of the cleaning brush and has a longer life span than the thin plate-shaped scraper.

However, if utilizing the technique for physically flicking toner by causing the scraper to thrust into the cleaning brush, when the toner is vigorously flicked, an air current is generated within a cleaning container. The toner is scattered outward from the image forming apparatus due to an effect of the air current, which forms an abnormal image. Thus, a sealing member for inhibiting the toner from being scattered is required for the cleaning container. If the round bar-shaped scraper is held in the cleaning container, a through hole needs to be created in the cleaning container and held by a bearing. However, the through hole can also be a scattering path. Thus, an oil seal is required to seal the through hole, resulting in not only an increase in cost but also deteriorates assembling properties.

As a measure for addressing this problem, when a thrust amount of the scraper is reduced, a generated air current and an amount of toner to be flicked can be reduced. However, the scraper does not sufficiently flick toner unless the thrust amount of the scraper is more than a desired amount. Thus, if the thrust amount of the scraper is reduced, a desired cleaning performance cannot be obtained. On the other hand, if the scraper is left for a long period of time while the scraper thrusts the cleaning brush by a predetermined amount or more, a portion where the scraper abuts on the cleaning brush is partially deformed in a concave shape, and does not sufficiently contact the image bearing member, thereby causing defective cleaning.

As described above, it is important that the thrust amount of the scraper into the cleaning brush is kept constant within a predetermined range.

To maintain the good assembly properties and keep the thrust amount of the scraper into a cleaning brush constant, a U-shaped groove having an opening portion is provided above in a direction of gravitational force, and a round bar scraper is placed into the groove, as illustrated in FIG. 5. In this case, if the assembly properties are improved and the scraper can be arranged such that a component force received by the scraper does not act toward an open space above the U-shaped groove, the thrust amount of the scraper can be kept constant. However, if the cleaning brush rotates in both forward and backward directions, the component force received by the scraper acts toward the open space above the U-shaped groove in at least either one of forward and backward rotations. Thus, the thrust amount of the scraper cannot be kept constant. Consequently, a desired thrusting amount cannot be ensured so that the scraper cannot sufficiently scrape toner. Alternatively, as a result, the scraper thrusting into the cleaning brush by a desired amount or more, a portion where the scraper abuts on the cleaning brush is partially deformed in a concave shape, thereby causing defective cleaning.

SUMMARY

According to an aspect of the present disclosure, a cleaning device includes a cleaning brush held rotatable in a forward direction and a backward direction and configured to remove toner remaining on an image bearing member, a cleaning container configured to contain the toner removed by the cleaning brush, a scraper extending in a direction substantially parallel to a rotation axis of the cleaning brush and having a shape of a circular in cross section, and configured to scrape toner which has entered the cleaning brush by thrusting the cleaning brush vertically below the rotation axis of the cleaning brush, and a holing portion configured to hold both ends of the scraper when the scraper is at a mounting position, the holding portion comprising an opening portion which opens toward the rotation axis of the cleaning brush to attach the scraper detachably to the holding portion, and a guide portion configured to guide movement of the scraper between the opening portion and the mounting position, and an angle θ between a line connecting the rotation axis of the cleaning brush and a center of the scraper and a direction in which the guide portion guides the scraper is set to within 15° when viewed in a direction of the rotation of the cleaning brush.

According to another aspect of the present disclosure, a cleaning device includes a cleaning brush held rotatable in a forward direction and a backward direction and configured to remove toner remaining on an image bearing member, a cleaning container configured to contain the toner removed by the cleaning brush, a scraper extending in a direction substantially parallel to a rotation axis of the cleaning brush and having a shape of a circular in cross section, and configured to scrape toner which has entered the cleaning brush by thrusting the cleaning brush vertically below the rotation axis of the cleaning brush, and a holding portion configured to hold both ends of the scraper when the scraper is at the mounting position, the holding portion comprising an opening portion which opens toward the rotation axis of the cleaning brush to attach the scraper detachably to the holding portion, and a guide portion configured to guide movement of the scraper between the opening portion and the mounting portion, in such a manner that a line connecting the rotation axis of the cleaning brush and a center of the scraper at the mounting position does not intersect with the guide portion when viewed in a direction of the rotation axis of the cleaning brush.

According to still another aspect of the present disclosure, an image forming apparatus includes an image forming unit configured to form a toner image in an image bearing member, a cleaning brush held rotatable in a forward direction and a backward direction and configured to remove toner remaining on the image bearing member, a cleaning container configured to contain the toner removed by the cleaning brush, a scraper extending in a direction substantially parallel to a rotation axis of the cleaning brush and having a shape of a circular in cross section, and configured to scrape toner which has entered the cleaning brush by thrusting the cleaning brush vertically below the rotation axis of the cleaning brush, and a holding portion configured to hold both ends of the scraper when the scraper is at a mounting position, the holding portion comprising an opening portion which opens toward the rotation axis of the cleaning brush to attach the scraper detachably to the holding portion, and a guide portion configured to guide movement of the scraper between the opening portion and the mounting position, and an angle θ between a line connecting the rotation axis of the cleaning brush and a center of the scraper and a direction in which the guide portion guides the scraper is set to within 15° when viewed in a direction of the rotation axis of the cleaning brush.

Further features of the present disclosure will become apparent from the following description of exemplary embodiments (with reference to the attached drawings).

DESCRIPTION OF THE EMBODIMENTS

A first exemplary embodiment of the present disclosure will be described below with reference to the drawings. A size, a material, a shape, and a relative arrangement of components described in the following exemplary embodiment are to be changed, as needed, depending on a configuration of an apparatus to which the present disclosure is applied, and various types of conditions, and the scope of the present disclosure is not limited to only those configurations.

Figure 1:
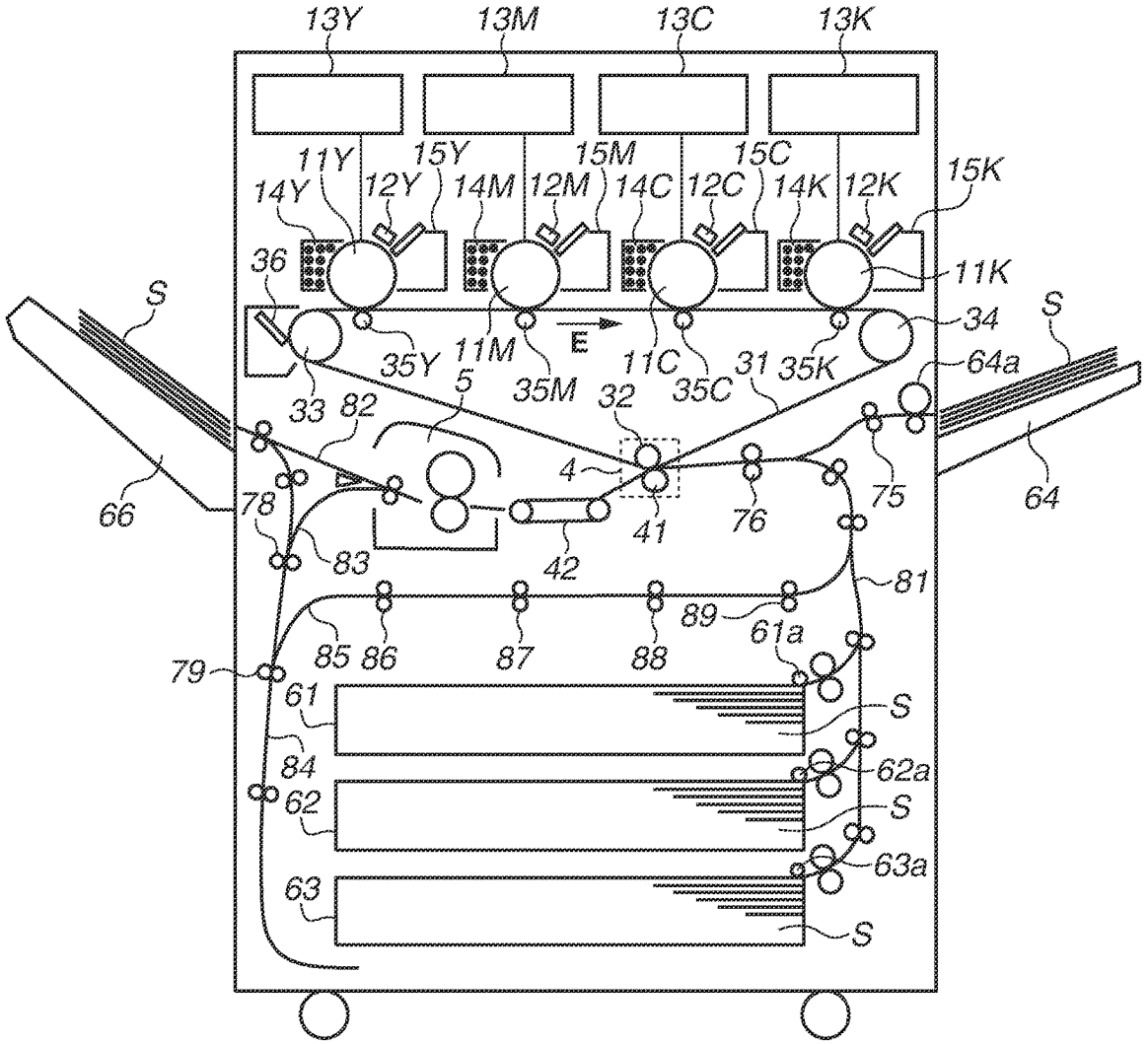
FIG. 1 is a schematic sectional view of an image forming apparatus according to an exemplary embodiment of the present disclosure.

FIG. 1 is a schematic sectional view of an image forming apparatus according to an example of the present exemplary embodiment.

<Transfer Sheet Conveyance Process>

Transfer sheets S are stored in a stacked manner in each of transfer sheet storages 61 to 64. The transfer sheet S is fed in conjunction with image formation timing by each of sheet feeding units 61*a* to 64*a*. The transfer sheet S fed by each of the sheet feeding units 61*a* to 64*a* is conveyed to a registration roller pair 76 serving as pre-transfer conveyance unit after passing through a conveyance path 81 and the like. The registration roller pair 76 has a function of creating a loop by causing the transfer sheet S conveyed from each of the transfer sheet storages 61 to 64 to abut on the registration roller pair 76, and thus causing a leading edge of the transfer sheet S to follow the loop to correct skew of the transfer sheet S. The registration roller pair 76 further has a function of conveying the transfer sheet S to a secondary transfer unit at a predetermined timing to match a timing of image formation on the transfer sheet S, i.e., a timing of transfer of a toner image borne on an image bearing member onto the transfer sheet S. The registration roller pair 76 feeds the transfer sheet S to the secondary transfer unit 4 at a desired timing after correcting the skew. In the secondary transfer unit 4, a secondary transfer inner roller 32 and a secondary transfer outer roller 41, which oppose each other, form a transfer nip section. The transfer sheet S is nipped by the transfer nip section, and a predetermined pressing force and an electrostatic load bias are applied to the transfer sheet S to transfer a toner image onto the transfer sheet S.

<Image Formation Process>

A process for forming an image on the transfer sheet S fed to the secondary transfer unit 4 at a similar timing to that of the process for conveying the transfer sheet S to the secondary transfer unit 4 described above will be described. The image forming unit mainly includes a photosensitive member 11 (11Y, 11M, 11C, and 11K), a charging device 12 (12Y, 12M, 12C, and 12K), an exposure device 13 (13Y, 13M, 13C, and 13K), and a development device 14 (14Y, 14M, 14C, and 14K). The image forming unit further includes a primary transfer device 35 (35Y, 35M, 35C, and 35K) and a photosensitive drum cleaner 15 (15Y, 15M, 15C, and 15K). The photosensitive member 11 has its surface previously charged by the charging device 12. The exposure device 13 is driven based on a signal of fed image information, to form a latent image on the rotating photosensitive member 11. An electrostatic latent image formed on the photosensitive member 11 is visualized as a toner image on the photosensitive member 11 through toner development by the development device 14. Then, a predetermined pressing force and an electrostatic load bias are applied by the primary transfer device 35, and the toner image is transferred onto an intermediate transfer belt 31. Then, slight transfer residual toner remaining on the photosensitive member 11 is recovered by the photosensitive drum cleaner 15, to prepare for subsequent image formation again. As the above-described image forming unit, four sets of image forming units corresponding to yellow (Y), magenta (M), cyan (C), and black (Bk) exist in FIG. 1. The number of colors is not limited to four, and an alignment sequence of colors is not limited to the case as described above.

The intermediate transfer belt 31 will be described below. The intermediate transfer belt 31 is stretched by rollers such as a drive roller 33, a tension roller 34, and a secondary transfer inner roller 32, and is conveyed and driven in a direction indicated by an arrow E. Image formation processes corresponding to colors Y, M, C, and Bk respectively processed in parallel by the above-described image forming units are performed in a superimposing fashion onto a toner image of a color primarily transferred onto the intermediate transfer belt 31. As a result, a full-color toner image is finally formed on the intermediate transfer belt 31, and is conveyed to the secondary transfer unit 4. The toner image conveyed to the secondary transfer unit 4 is transferred onto the transfer sheet S by applying a predetermined pressing force and an electrostatic load bias to the transfer sheet S, as described above. Then, the slight transfer residual toner remaining on the intermediate transfer belt 31 is recovered by the transfer belt cleaner 36.

<Process After Secondary Transfer>

A full-color toner image is secondarily transferred onto the transfer sheet S in the secondary transfer unit 4 through a conveyance process and an image formation process of the transfer sheet S described above. Then, the transfer sheet S is conveyed to the fixing device 5 by a suction conveyance unit 42. The suction conveyance unit 42 conveys the transfer sheet S by suctioning air with use of a fan. The fixing device 5 melts and fixes the toner image on the transfer sheet S by adding a predetermined pressing force exerted by an opposing roller or belt and generally a heating effect produced by a heat source such as a heater. A Path for the transfer sheet S having a fixed image thus obtained is selected depending on whether the sheet S is to be conveyed to a sheet discharge conveyance path 82 for directly discharging the transfer sheet S onto a sheet discharge tray 66, or conveyed to a reverse guidance path 83 in a case where two-sided image formation is performed. If the two-sided image formation is performed, the transfer sheet S is drawn into a switchback path 84 from the reverse guidance path 83 and is conveyed to a two-sided conveyance path 85 after a leading edge and a trailing edge of the transfer sheet S are exchanged by reversing a rotation direction of a reverse B roller pair 79 (a switchback operation). Then, the transfer sheet S joins a transfer sheet S for a subsequent job which is conveyed by each of the sheet feeding units 61*a* to 64*a* at the same timing, and is similarly fed to the secondary transfer unit 4 via the registration roller pair 76. A process for forming an image on a reverse surface (second surface) is similar to that on a front surface (first surface) as described above, and hence description thereof is not repeated. Further, in a case where the transfer sheet S is reversed and discharged, the transfer sheet S is conveyed to the switchback path 84 from the reverse guidance path 83 after the transfer sheet S has passed through the fixing device 5. After the transfer sheet S is drawn into the switchback path 84, the transfer sheet S exits in a direction opposite to a direction in which the transfer sheet S has been drawn into the switchback path 84, with its trailing edge serving as a leading edge this time, and is discharged onto the sheet discharge tray 66.

<Cleaning Device According to Present Exemplary Embodiment>

A cleaning device according to the present exemplary embodiment will be specifically described below.

Figure 2:
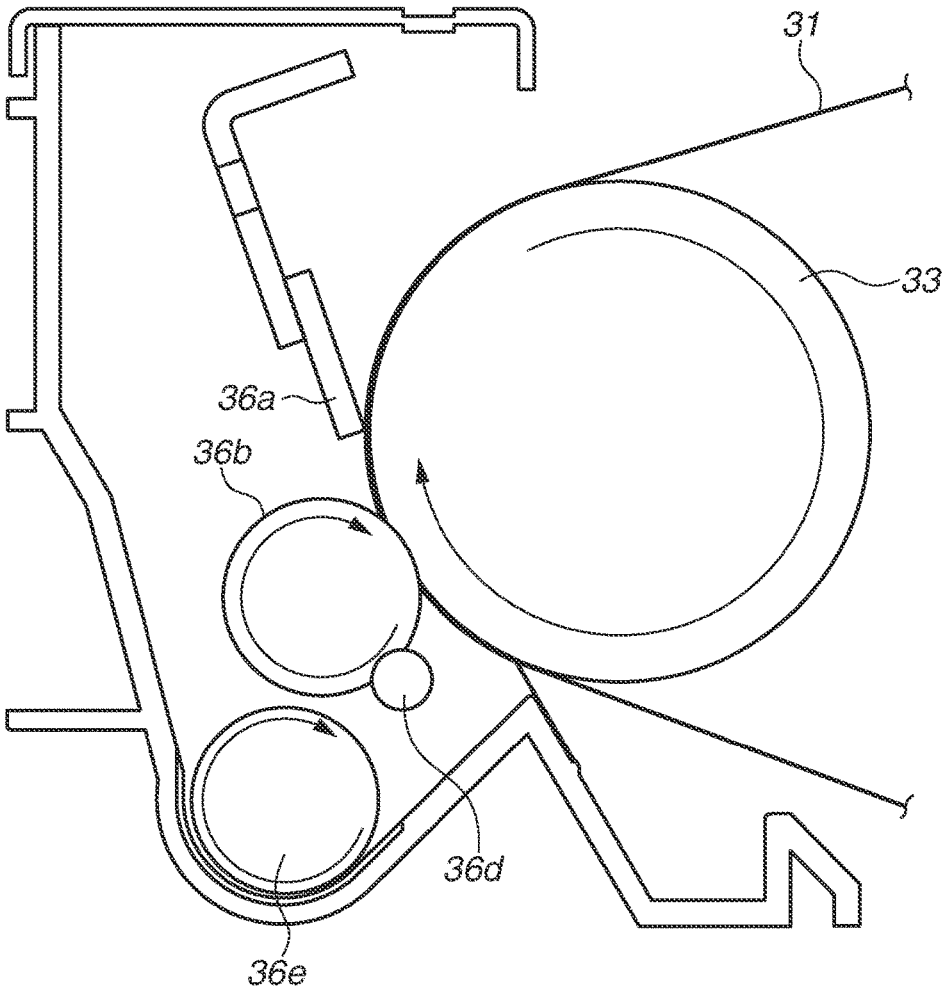
FIG. 2 is a partially sectional view of a transfer belt cleaning unit including a fur brush and a cleaning blade according to an exemplary embodiment of the present disclosure.

FIG. 2 is a partially sectional view of a transfer belt cleaner unit 36 including a fur brush and a cleaning blade.

While the transfer belt cleaner unit 36 will be described below, the present disclosure is not limited to this exemplary embodiment. With the photosensitive drum cleaner unit 15, a similar effect is also obtained.

The transfer belt cleaner unit 36 according to the present exemplary embodiment includes a cleaning blade 36*a* serving as a cleaning member. The transfer belt cleaner unit 36 further includes a fur brush 36*b* serving as an auxiliary cleaning member and arranged upstream of the cleaning blade 36*a* in a rotation direction of the intermediate transfer belt 31. The transfer belt cleaner unit 36 further includes a scraper 36*d* arranged vertically below an axial center position of the fur brush 36*b* to scrape toner or foreign matter which has entered bristles of the fur brush 36*b*. The transfer belt cleaner unit 36 further includes a cleaning container 36*g* which contains the toner scraped with the cleaning blade 36*a* or the fur brush 36*b*.

The transfer belt cleaner unit 26 further includes a conveyance screw 36*e* which conveys the toner scraped with the cleaning blade 36*a* or the fur brush 36*b* outward from the cleaning container 36*g*.

As described above, the slight transfer residual toner remaining on the intermediate transfer belt 31 downstream of the secondary transfer unit 4 is fed to the transfer belt cleaner unit 36. At this time, not only the transfer residual toner but also very small foreign matter or paper dust on the transfer sheet S is fed to the transfer belt cleaner unit 36.

The cleaning blade 36*a* includes a rubber material such as urethane rubber. If foreign matter such as paper dust other than toner is fed to a blade nip of the cleaning blade 36*a*, the foreign matter may be nipped by the blade nip. This causes defective cleaning. Thus, the fur brush 36*b* formed of an acrylic fiber, for example, is provided to remove such foreign matter upstream of the cleaning blade 36*a*.

The fur brush 36*b* rotates in an opposite direction (counter direction) to a conveyance direction of the intermediate transfer belt 31, and knocks off a part of the transfer residual toner and the foreign matter which have been brought by the intermediate transfer belt 31.

Then, the cleaning blade 36*a* scrapes the residual transfer toner on the intermediate transfer belt 31 which has not been removable even by the fur brush 36*b*.

Figure 3A:
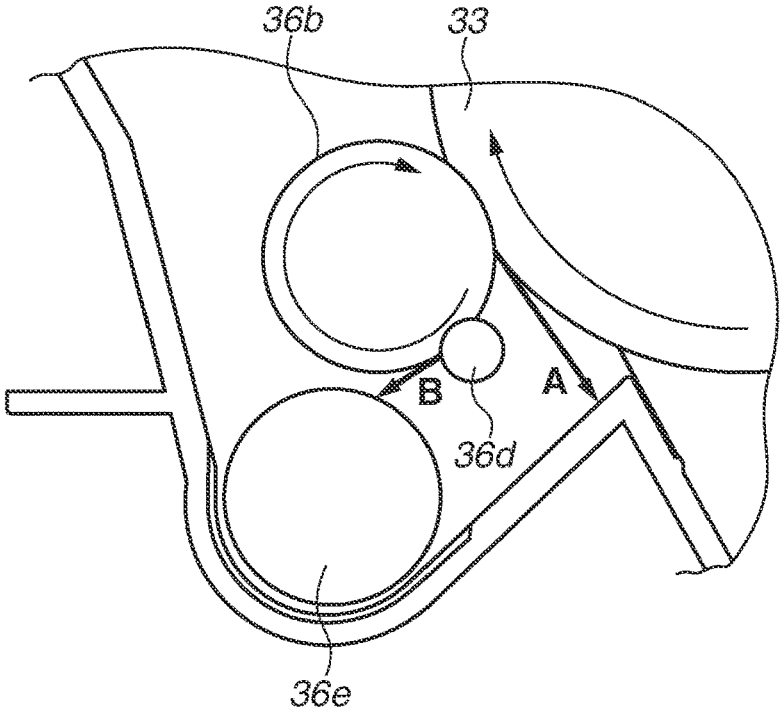
FIGS. 3A and 3B are explanatory views each illustrating a direction in which toner is flicked by the fur brush according to an exemplary embodiment of the present disclosure.

As illustrated in FIG. 3A, the toner which has been scraped by the cleaning blade 36*a* and entered the bristles of the fur brush 36*b* is flicked in a direction indicated by an arrow A by the rising up bristles of the fur brush 36*b*. The fur brush 36*b* thrusts the intermediate transfer belt 31 to be deformed. Similarly, a part of the residual transfer toner, which has been carried by the intermediate transfer belt 31, is flicked in the direction indicated by the arrow A by the rising up bristles of the fur brush 36*b*, which has thrusted the intermediate transfer belt 31 to be deformed. The toner, which has entered the bristles of the fur brush 36*b*, but not been flicked by the rising up bristles in a nip portion between the intermediate transfer belt 31 and the fur brush 36*b*, is flicked by the scraper 36*d*. More specifically, the toner is flicked to the conveyance screw 36*e* in a direction indicated by an arrow B by the rising up bristles of the fur brush 36*b* deformed by the scraper 36*d* disposed there, which has thrusted the fur brush 36*b*.

Figure 3B:
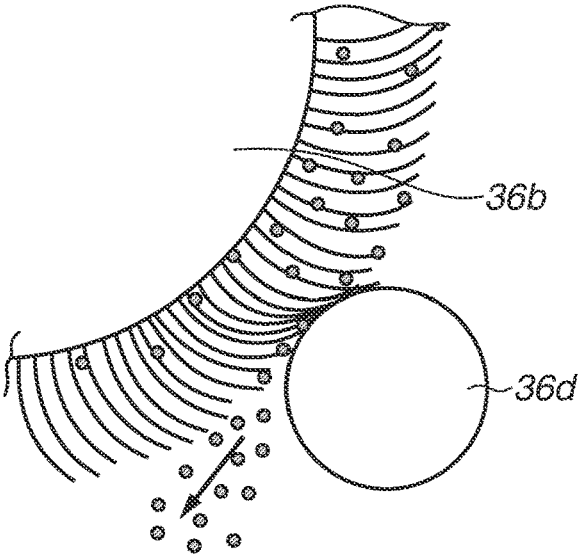

Regularly, the toner which has entered the bristles, is flicked in a tangential direction of the fur brush 36*b* in a nip portion by the rising up bristles of the deformed fur brush 36*b*, as illustrated in FIG. 3B.

The toner is thus swiftly flicked by the rising up bristles of the fur brush 36*b*, so that an air current is generated within the cleaning container 36*g*. The toner is scattered outward from the cleaning container 36*g* due to an effect of the air current, which generates an abnormal image. Therefore, the cleaning container 36*g* is provided with a sealing member for inhibiting scatter of the toner.

If a thrust amount of the scraper 36*d* into the fur brush 36*b* is small, the scraper 36*d* does not sufficiently flick the toner which has entered the fur brush 36*b*. In this case, the toner contacts the intermediate transfer belt 31 while entering the fur brush 36*b*. Therefore, a scraping capability of the scraper 36*d* is naturally reduced. On the other hand, if the thrust amount of the scraper 36*d* into the fur brush 36*b* is large, when the scraper 36*d* is left for a long period of time in this state, a portion where the scraper 36*d* abuts on the fur brush 36*b* is partially deformed in a concave shape. That portion does not sufficiently contact the intermediate transfer belt 31, thereby causing defective cleaning. Accordingly, the thrust amount of the scraper 36*d* into the fur brush 36*b* needs to be kept constant within a predetermined range to maintain a cleaning performance of the fur brush 36*b*.

Figure 4:
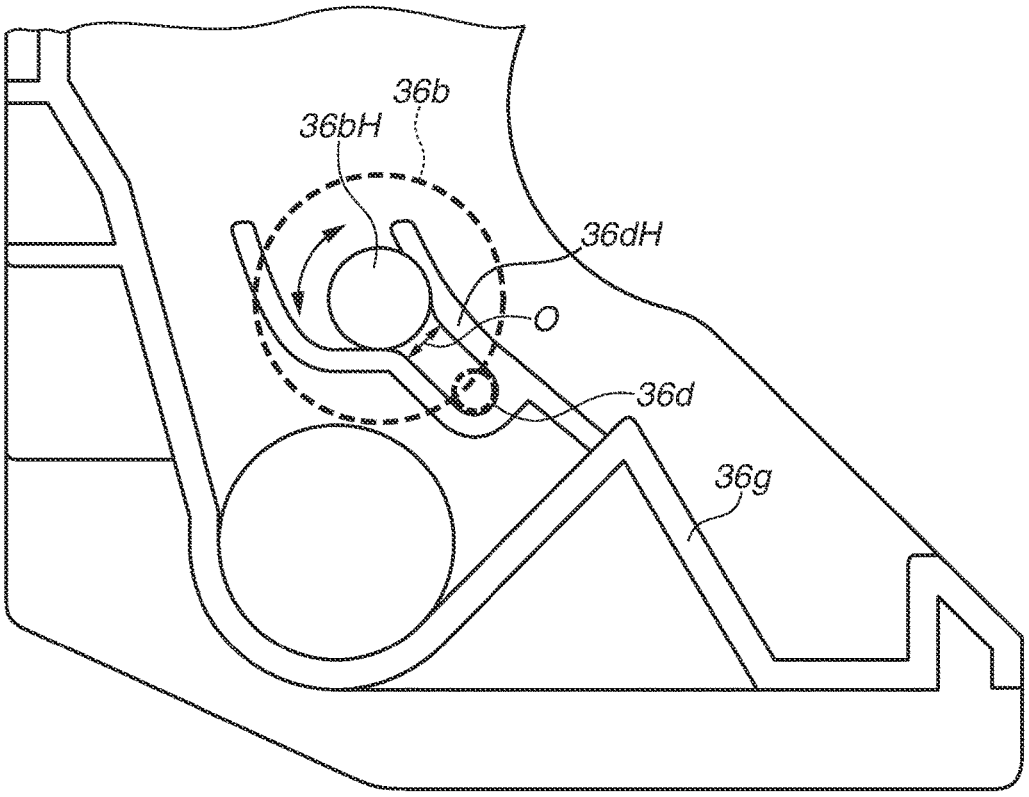
FIG. 4 is a cross-sectional view of a scraper holding unit according to an exemplary embodiment of the present disclosure.

Next, methods for installing and holding the scraper 36*d* in the apparatus will be described below with reference to FIG. 4.

In the present exemplary embodiment, the scraper 36*d* is made of a metallic material such as a sulfur or sulfur composite free-cutting steel material (SUM) or a stainless steel (SUS) material. If a material for the scraper 36*d* is resin, for example, the scraper 36*d* can be cut away due to rubbing against the fur brush 36*b*. As a result, the thrust amount of the scraper 36*d* is reduced. As a result, a scraping capability of the scraper 36*d* is reduced with respect to permanence. Thus, the material used for the scraper 36*d* desirably includes a metallic material which is not easily cut away.

Further, the scraper 36*d* has a bar shape which is round in cross section (a column shape). The round bar-shaped scraper is more advantageous for cutting-away of the bristles of the fur brush 36*b* and retains an enhanced life than a thin plate-shaped scraper.

A general method for holding the scraper 36*d* having such a round bar shape includes creating a through hole in the cleaning container 36*g* and holding with a bearing. However, in such a case, the toner can be easily scattered due to the air current within the cleaning container 36*g*, as described above. Therefore, when the through hole is created in the cleaning container 36*g*, the through hole can become a scattering path. As a measure for preventing this phenomenon, the scatter of the toner can be inhibited by using an oil seal for a bearing portion to seal the through hole, which naturally results in an increase in cost. Further, it is not desirable that the shaft-shaped scraper 36*d* is installed by passing it through the through hole, from the viewpoint of an assembling process, and the number of installing processes also increases when the bearing or the oil seal is used.

Figure 5:
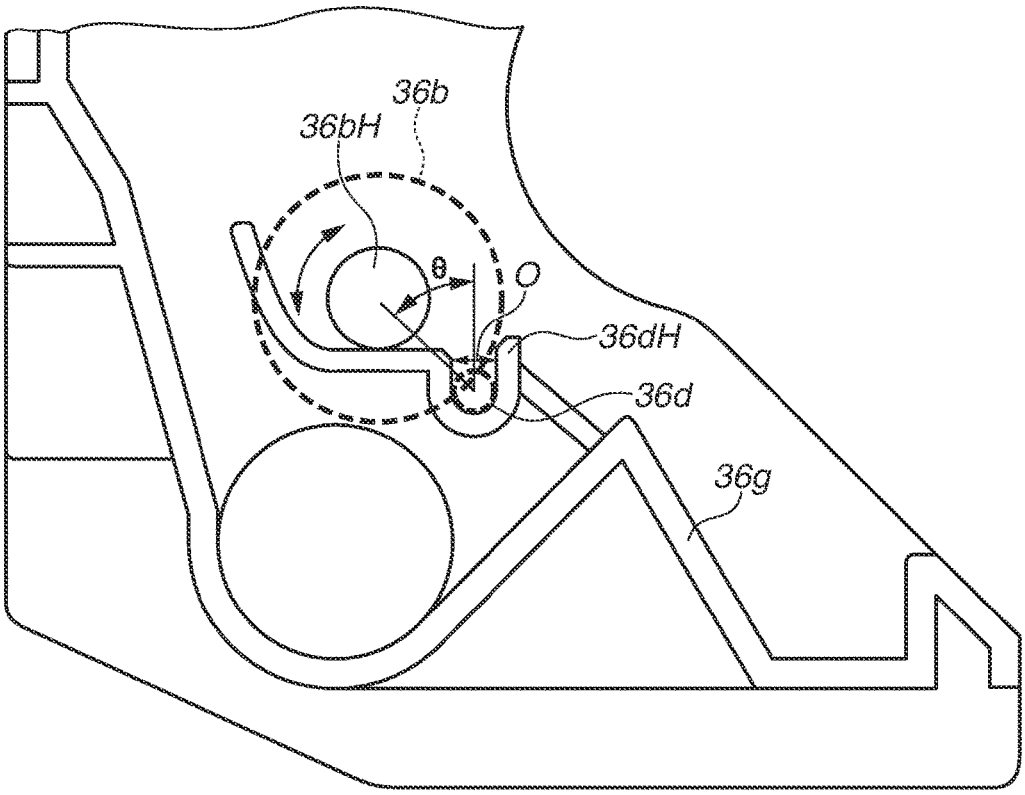
Prior Art FIG.5
FIG. 5 is a cross-sectional view of a scraper holding unit according to a comparative prior art example.

Accordingly, as a configuration having the good assembling property which does not require the through hole, a U-shaped groove having an opening portion O is provided above in a direction of gravitational force and a round bar-shaped scraper 36*d* is dropped into the groove (FIG. 5).

However, if the fur brush 36*b* rotates in both forward and backward directions, a thrust amount of the round bar-shaped scraper 36*d* into the fur brush 36*b* cannot be kept constant in the above-described configuration only by dropping the scraper 36*d* into the groove.

The reason why the thrust amount of the scraper 36*d* into the fur brush 36*b* cannot be kept constant will be described below with reference to FIG. 6.

Figure 6A:
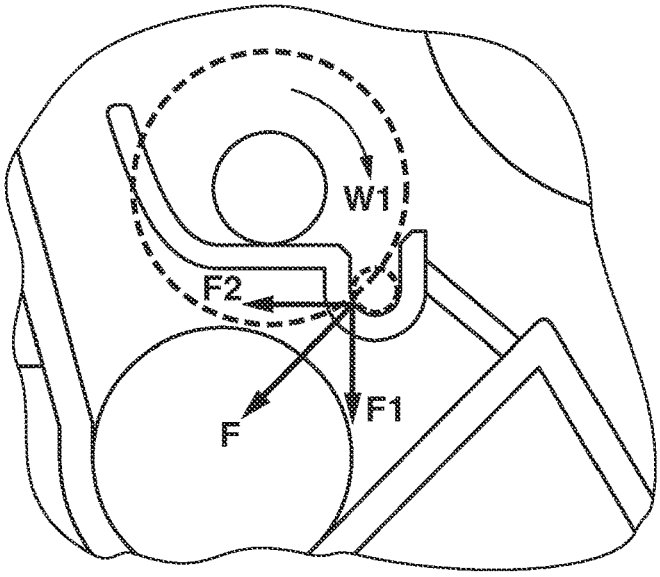
Prior Art FIG.6A
FIGS. 6A and 6B are explanatory views each illustrating a direction of a component force received from a fur brush by a scraper according to the comparative prior art example.

FIG. 6A illustrates a direction of a force received by the scraper 36*d* when the fur brush 36*b* rotates in a forward direction W1 at the time of a normal image forming operation. If the fur brush 36*b* rotates in the forward direction W1 at the time of the normal image forming operation, the fur brush 36*b* rotates in a direction (counter direction) opposite to a conveyance direction of the intermediate transfer belt 31. In this case, the scraper 36*d* receives a force F from the fur brush 36*b* in a tangential direction of the fur brush 36*b* in a nip portion by the rising up bristles of the fur brush 36*b*. A component force of the force F received by the scraper 36*d* is split into a component force F1 in a wall surface direction along a wall surface and a component force F2 in a direction perpendicular to the wall surface direction, as illustrated in FIG. 6A. The component force F1 in the wall surface direction along the wall surface is directed toward the opposite side of the opening portion O of the groove. Therefore, the scraper 36*d* is urged toward the bottom of the groove, so that the thrust amount is kept constant.

Figure 6B:
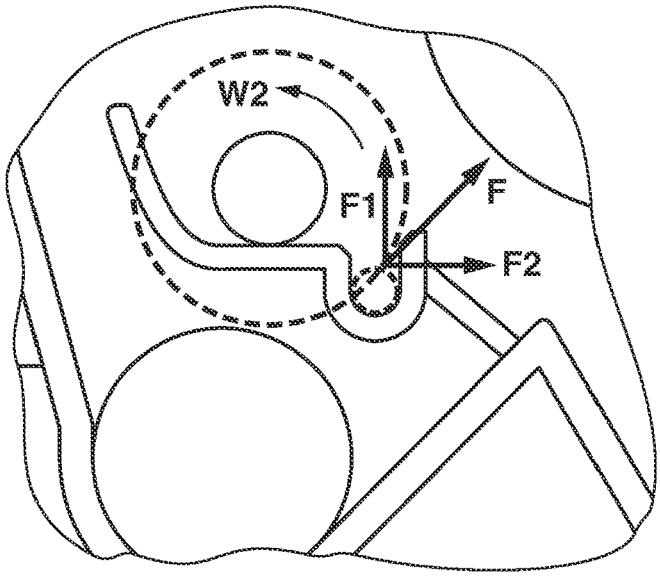
Prior Art FIG.6B

On the other hand, if the fur brush 36*b* rotates in a backward direction W2, as illustrated in FIG. 6B, the scraper 36*d* receives a force F from the fur brush 36*b* by the rising up bristles of the fur brush 36*b*. While a component force of the force F received by the scraper 36*d* is split into a component force F1 in a wall surface direction along a wall surface and a component force F2 in a direction perpendicular to the wall surface direction, as illustrated in FIG. 6B, the component force F1 in the wall surface direction is directed toward the opening portion O of the groove. Thus, the scraper 36*d* receives a floating force from the bottom of the groove, so that the thrust amount cannot be kept constant. Further, if the groove is shallow as illustrated in FIG. 6B, the scraper 36*d* may drop from the groove under the component force F1 in the worst case. In the present exemplary embodiment, the fur brush 36*b* is provided rotatable in the forward direction and the backward direction, as described below. The forward direction of the fur brush 36*b* refers to a direction in which the fur brush 36*b* rotates at the time of normal image formation.

Figure 7:
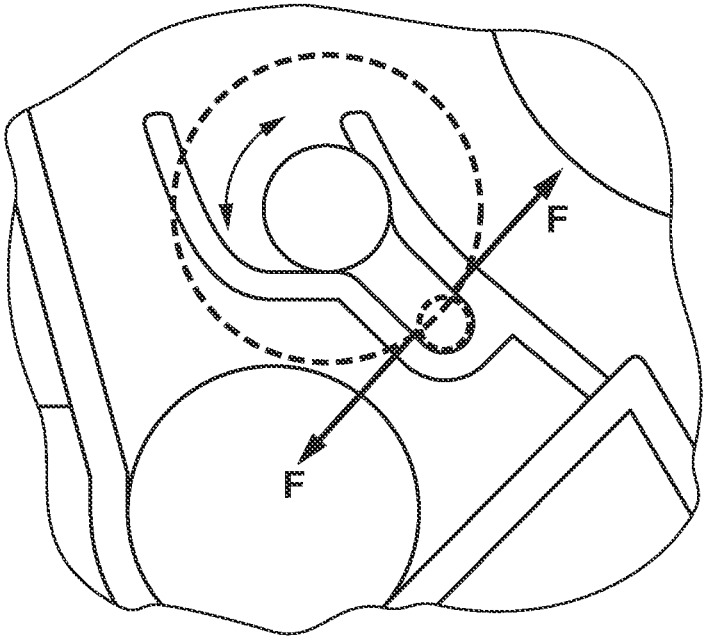
FIG. 7 is an explanatory view illustrating a direction of a force received from the fur brush by a scraper according to an exemplary embodiment of the present disclosure.

FIG. 7 illustrates the cleaning device according to the present exemplary embodiment. As illustrated in FIG. 7, a cleaning container 36*g* is provided with a scraper holding unit (portion) 36*d*H which holds both ends of the scraper 36*d* (see FIG. 4). The scraper holding unit 36*d*H includes a substantially U-shaped groove which holds the scraper 36*d* while guiding the scraper 36*d* to a mounting position. The scraper holding unit 36*d*H is provided with an opening portion O which makes the scraper 36*d* located at the mounting position detachably attached in a direction perpendicular to an axial direction of the scraper 36*d*. The opening portion O opens toward the center of the fur brush 36*b*. In other words, a center line connecting a rotation center of the fur brush 36*b* and the center of the scraper 36*d*, which are located at the mounting position, passes through the opening portion O. In the present exemplary embodiment, an angle θ between the center line connecting the rotation center of the fur brush 36*b* and the center of the scraper 36*d* and a guiding direction of the scraper holding unit 36*d*H as illustrated in FIG. 5, is zero. Thus, regardless whether the fur brush 36*b* rotates in the forward direction or the backward direction, the component force of the force F received by the scraper 36*d* does not act in a direction parallel to the wall surface of the groove. Therefore, the thrust amount can be kept constant.

In the present exemplary embodiment, the groove guides the scraper 36*d* located at the mounting position, toward the rotation center of the fur brush 36*b*. More specifically, in a cross section perpendicular to the axial direction of the scraper 36*d*, a line passing through the center of the groove width of the scraper holding unit 36*d*H at the mounting position of the scraper 36*d* and parallel to a direction in which the scraper 36*d* is detachably attached at the mounting position of the scraper 36*d*, passes through the rotation center of the scraper 36*d*. In the present exemplary embodiment, the scraper holding unit 36*d*H guides the scraper 36*d* from the opening portion O to the mounting position of the scraper 36*d*. When the scraper 36*d* is mounted on the scraper holding unit 36*d*H, the scraper holding unit 36*d*H regulates a direction in which a position of the scraper 36*d* is oriented perpendicular to a guiding direction. More specifically, the scraper holding unit 36*d*H regulates movement of the scraper 36*d* relative to a movement direction of the fur brush 36*b*. In the present exemplary embodiment, the groove width of the scraper holding unit 35*d*H at the mounting position of the scraper 36*d* is slightly larger than the diameter of the scraper 36*d*, so that a clearance is generated therebetween. In the present exemplary embodiment, the groove is in a straight shape to linearly guide the scraper 36*d* from the opening portion O to the mounting position. Further, the groove width of the scraper holding unit 36*d*H is substantially constant in a guiding direction of a guide unit. However, the present disclosure is not limited to the present exemplary embodiment. The groove width of the scraper holding unit 36*d*H may increase upstream of the mounting position in an insert direction of the scraper 36*d* from the viewpoint of a mounting property of the scraper 36*d*, and the guiding direction need not be straight. However, it is desirable that the groove width of the scraper holding unit 36*d*H is substantially constant at least in the vicinity of the mounting position of the scraper 36*d* to regulate positioning of the scraper 36*d* at the mounting position. The guiding direction of the groove of the scraper holding unit 35*d*H is desirably directed toward the center of the fur brush 36*b*. However, the angle θ between the center line connecting the center of the fur brush 36*b* and the center of the scraper 36*d*, and the guiding direction of the scraper holding unit 36*d*H may be set within 15° as illustrated in FIG. 5. More preferably, the angle θ may be within ±10°. More preferably, the angle θ may be within ±5°. Thus, a thrust amount of the scraper 36*d* made of a metal can be kept constant. This is because a component force exerted in a direction parallel to the wall surface of the groove under the self-weight of the scraper 36*d* made of a metal becomes larger than the component force F1 exerted in the direction parallel to the wall surface of the groove received by the scraper 36*d* from the fur brush 36*b*.

Figure 8:
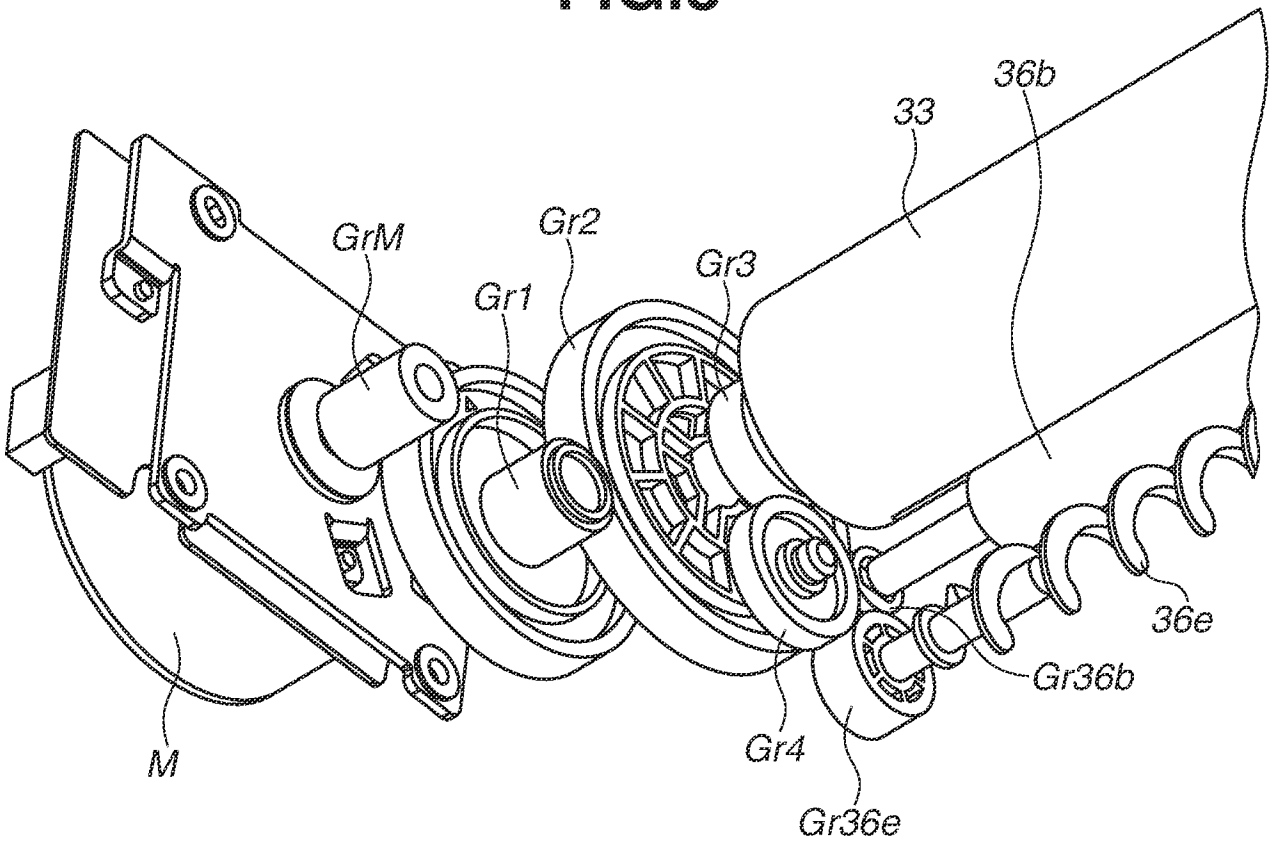
FIG. 8 is an explanatory view illustrating driving columns of a drive roller stretching an intermediate transfer belt and a fur brush according to an exemplary embodiment of the present disclosure.

The exemplary embodiment concerning rotations in both the forward and backward directions of the fur brush 36*b* has been described above. In the present exemplary embodiment, the fur brush 36*b* is configured to be rotatable in both the forward and backward directions from the following reasons. Conventionally, a drive source of the fur brush 36*b* tends to be the same as a drive source of the image bearing member from the viewpoint of cost. FIG. 8 illustrates driving columns of the drive roller 33 stretching the intermediate transfer belt 31 and the fur brush 36*b* according to the present exemplary embodiment. In the present exemplary embodiment, not only the drive roller 33 and the fur brush 36*b* but also the conveyance screw 36*e* is driven by the same drive motor M. A motor gear GrM is attached to a head of a drive shaft of the drive motor M, and is rotated by the drive motor M. A reduction gear Gr1 engages with the motor gear GrM, and the number of rotations of the reduction gear Gr1 is reduced to rotate a drive roller larger gear Gr2 attached to an axis of the drive roller 33. Another drive roller smaller gear Gr3 is attached on the axis of the drive roller 33, to identically rotate together with the drive roller 33. An idler gear Gr4 engages with the drive roller smaller gear Gr3, and a driving force of the drive roller smaller gear Gr3 is transmitted to the idler gear Gr4. A fur brush drive gear Gr36*b* and a screw drive gear Gr36*e* are respectively attached on an axis of the fur brush 36*b* and an axis of the conveyance screw 36*e*. The fur brush drive gear Gr36*b* and the screw drive gear Gr36*e* engage with the idler gear Gr4, and a driving force is transmitted from the drive motor M to the idler gear Gr4.

Thus, the drive roller 33, the fur brush 36*b*, and the conveyance screw 36*e* are driven by the same drive source. Therefore, when the intermediate transfer belt 31 serving as the image bearing member is rotated backward, the fur brush 36*b* naturally rotates backward. In the present exemplary embodiment, the intermediate transfer belt 31 is rotated backward as a measure to prevent the cleaning blade 36*a* from riding up. While the fur brush 36*b*, together with the image bearing member, has been thus conventionally rotated in both the forward and backward directions, the thrust amount of the scraper 36*d* cannot be kept constant if the above-described configuration is not used in such a case.

As a measure for addressing this problem and to differentiate the drive source of the fur brush 36*b* and the drive source of the image bearing member from each other, it is conceivable to rotate the fur brush 36*b* only forward in the first place. However, one more drive source needs to be added, which results in an increase in cost. While the fur brush 36*b* can be configured to rotate only forward by inserting a one-way clutch into the driving column of the fur brush 36*b*, this also results in an increase in cost.

Even if the fur brush 36*b* can be driven to rotate only in the forward direction by the drive source, the fur brush 36*b* may need to rotate backward in a case of maintenance work. For example, to inhibit the cleaning blade 36*a* from riding up, a lubricant may be previously applied to an upstream side of a nip of the cleaning blade 36*a* when the cleaning blade 36*a* is detached or attached. While the lubricant is desirably applied to an immediate upstream side of the blade nip, the immediate upstream side of the blade nip cannot necessarily be accessed at the time of maintenance work. In that case, when a downstream side of the blade nip is easily accessed, the image bearing member is manually rotated backward after the lubricant is applied to the downstream side. The cleaning blade 36*a* is installed after a portion to which the lubricant has been applied comes to the upstream side of the blade nip. To manually rotate the image bearing member backward, a bracket portion of the drive motor M and the drive roller larger gear Gr2 may be manually rotated.

Thus, even if the fur brush 36*b* can be driven to rotate only in the forward direction by the drive source, the fur brush 36*b* may manually rotate backward. Therefore, if the fur brush 36*b* is held rotatable in both the directions, the present disclosure becomes effective.

As described above, according to the present disclosure, the cleaning device can be easily installed and the toner scatter can be inhibited without increasing cost. Further, the present disclosure can provide a cleaning device in which thrust amounts of the fur brush 36*b* and the scraper 36*d* can be kept constant even if the cleaning device rotates in both the forward and backward directions, and an image forming apparatus including the same.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-138755, filed Jul. 13, 2016, which is hereby incorporated by reference herein in its entirety.

What is claimed is:

1. A cleaning device comprising:

a cleaning brush held rotatable in a forward direction and a backward direction and configured to remove toner remaining on an image bearing member;

a cleaning container configured to contain the toner removed by the cleaning brush;

a scraper extending in a direction substantially parallel to a rotation axis of the cleaning brush and having a shape of a circular in cross section, and configured to scrape toner which has entered the cleaning brush by thrusting the cleaning brush vertically below the rotation axis of the cleaning brush; and a holding portion configured to hold both ends of the scraper when the scraper is at a mounting position, the holding portion comprising an opening portion which opens toward the rotation axis of the cleaning brush to attach the scraper detachably to the holding portion, and a guide portion configured to guide movement of the scraper between the opening portion and the mounting position, and an angle θ between a line connecting the rotation axis of the cleaning brush and a center of the scraper, and a direction in which the guide portion guides the scraper is set to within 15° when viewed in a direction of the rotation axis of the cleaning brush.

2. The cleaning device according to claim 1, wherein a driving force is transmitted from a drive source to the cleaning brush so that the cleaning brush is driven to rotate.

3. The cleaning device according to claim 1, wherein the image bearing member and the cleaning brush are driven by the same drive source.

4. The cleaning device according to claim 1, wherein the scraper is made of metal.

5. The cleaning device according to claim 1, wherein the angle θ is within 10°.

6. The cleaning device according to claim 1, wherein the angle θ is within 5°.

7. A cleaning device comprising:

a cleaning brush held rotatable in a forward direction and a backward direction and configured to remove toner remaining on an image bearing member;

a cleaning container configured to contain the toner removed by the cleaning brush;

a scraper extending in a direction substantially parallel to a rotation axis of the cleaning brush and having a shape of a circular in cross section, and configured to scrape toner which has entered the cleaning brush by thrusting the cleaning brush vertically below the rotation axis of the cleaning brush; and a holding portion configured to hold both ends of the scraper when the scraper is at a mounting position, the holding portion comprising an opening portion which opens toward the rotation axis of the cleaning brush to attach the scraper detachably to the holding portion, and a guide portion configured to guide movement of the scraper between the opening portion and the mounting position, in such a manner that a line connecting the rotation axis of the cleaning brush and a center of the scraper at the mounting position does not intersect with the guide portion when viewed in a direction of the rotation axis of the cleaning brush.

8. An image forming apparatus comprising:

an image forming unit configured to form a toner image in an image bearing member;

a cleaning brush held rotatable in a forward direction and a backward direction and configured to remove toner remaining on the image bearing member;

a cleaning container configured to contain the toner removed by the cleaning brush;

a scraper extending in a direction substantially parallel to a rotation axis of the cleaning brush and having a shape of a circular in cross section, and configured to scrape toner which has entered the cleaning brush by thrusting the cleaning brush vertically below the rotation axis of the cleaning brush; and a holding portion configured to hold both ends of the scraper when the scraper is at a mounting position, the holding portion comprising an opening portion which opens toward the rotation axis of the cleaning brush to attach the scraper detachably to the holding portion, and a guide portion configured to guide movement of the scraper between the opening portion and the mounting position, and an angle θ between a line connecting the rotation axis of the cleaning brush and a center of the scraper, and a direction in which the guide portion guides the scraper is set to within 15° when viewed in a direction of the rotation axis of the cleaning brush.

9. A brush driving device comprising:

a brush held rotatable and configured to contact on an image bearing member;

a bar extending in a direction substantially parallel to a rotation axis of the brush and having a shape of a circular in a cross section perpendicular to the rotation axis of the brush, and configured to thrust the brush;

a U-shaped holding portion configured to hold both ends of the bar when the bar is at a mounting position; and a motor configured to drive the brush;

wherein the U-shaped holding portion including a guide portion configured to guide the bar to the mounting position in a guiding direction, an angle Θ between a line segment connecting a center of the brush and a center of the bar, and a the guiding direction of the guide portion is set to within 15°.

10. The brush driving device according to claim 9, wherein the bar is provided at vertically below the rotation axis line of the brush.

11. The brush driving device according to claim 9, wherein-the line segment connecting the center of the brush and the center of the bar intersects with a vertical direction.

12. The brush driving device according to claim 9, wherein the guiding direction of the guide portion intersecting with a vertical direction.

13. The brush driving device according to claim 9, wherein the angle θ is set to within 5°.

14. The brush driving device according to claim 9, wherein the motor drives the brush and the image bearing member.

15. The brush driving device according to claim 9, wherein the brush is held rotatable in a forward direction and a backward direction and the brush is driven in the forward direction by the motor.

* * * * *